US007490363B2

(12) United States Patent
Hildebrandt et al.

(10) Patent No.: US 7,490,363 B2
(45) Date of Patent: Feb. 17, 2009

(54) HAND HARNESS FOR EXERCISE EQUIPMENT

(75) Inventors: Mark Hildebrandt, Saline, MI (US); Roger Fettes, Ann Arbor, MI (US); Douglas Hennigar, Ann Arbor, MI (US)

(73) Assignee: Nustep, Inc., Ann Arbor, MI (US)

( * ) Notice: Subject to any disclaimer, the term of this patent is extended or adjusted under 35 U.S.C. 154(b) by 443 days.

(21) Appl. No.: 11/299,492

(22) Filed: Dec. 12, 2005

(65) Prior Publication Data

US 2007/0130664 A1 Jun. 14, 2007

(51) Int. Cl.
*A41D 19/00* (2006.01)

(52) U.S. Cl. ..... 2/160; 2/17

(58) Field of Classification Search ..... 2/17, 2/160, 163; 294/25; 602/5, 21; 482/44; 601/40; 224/218
See application file for complete search history.

(56) References Cited

U.S. PATENT DOCUMENTS

| | | | | |
|---|---|---|---|---|
| 1,681,389 | A | 8/1928 | Blake | |
| 2,301,842 | A | 11/1942 | Abdella | |
| 3,348,238 | A | 10/1967 | Hudock | |
| 3,358,527 | A * | 12/1967 | Lake et al. | 74/484 R |
| 3,417,840 | A | 12/1968 | Farnsworth, Jr. | |
| 3,520,539 | A | 7/1970 | Haws | |
| 3,541,990 | A | 11/1970 | Du Mas | |
| 3,774,242 | A | 11/1973 | Owen | |
| 4,247,097 | A | 1/1981 | Schwartz | |
| 4,402,502 | A | 9/1983 | Peters | |
| 4,447,912 | A | 5/1984 | Morrow | |
| 4,484,740 | A | 11/1984 | Green | |
| 4,487,412 | A | 12/1984 | Meeko | |
| 4,698,850 | A | 10/1987 | Patton et al. | |
| 4,793,005 | A | 12/1988 | Hetzel, Jr. | |
| 4,809,974 | A | 3/1989 | Buhr | |
| 5,004,231 | A | 4/1991 | Alread | |
| 5,022,094 | A | 6/1991 | Hames | |
| 5,182,814 | A | 2/1993 | Christensen | |
| 5,336,147 | A | 8/1994 | Sweeney | |
| 5,375,263 | A * | 12/1994 | Cuccia | 2/158 |
| 5,435,013 | A | 7/1995 | Davis | |
| 5,553,324 | A | 9/1996 | Emerson | |
| 5,678,730 | A | 10/1997 | Fabek et al. | |
| 5,685,809 | A | 11/1997 | Murray | |
| 5,853,210 | A * | 12/1998 | Robinson | 294/25 |
| 6,035,442 | A | 3/2000 | Marando | |
| 6,220,991 | B1 | 4/2001 | Sellers | |
| 6,233,743 | B1 * | 5/2001 | Cummins | 2/160 |
| 6,394,516 | B1 * | 5/2002 | Zhuravsky | 294/25 |
| 6,708,582 | B1 | 3/2004 | McJunkin et al. | |
| 6,834,397 | B1 | 12/2004 | Murphy | |

* cited by examiner

*Primary Examiner*—Katherine Moran
(74) *Attorney, Agent, or Firm*—Brinks Hofer Gilson & Lione

(57) ABSTRACT

The invention relates to a hand harness for use with exercise and healthcare equipment such as a recumbent cross trainer. The harness includes an adjustable mount, a surface attached to the adjustable mount and a glove attached to the surface. The glove has adjustable portions which extend around the user's hand, locking the hand into place.

14 Claims, 4 Drawing Sheets

HAND HARNESS FOR EXERCISE EQUIPMENT

BACKGROUND OF THE INVENTION

1. Field of the Invention

The present invention generally relates to hand harnesses for aiding in the operation of exercise and healthcare equipment.

2. Description of the Known Technology

Exercise equipment requires the user to properly operate the equipment in order to obtain maximum results and to prevent injury. Upper body exercise equipment, such as cardiovascular machines, have handlebars that allow the user to operate the equipment by gripping the handlebars with the user's hands and pushing and/or pulling the handlebars in a repetitive motion.

It has been discovered that some users of exercise equipment are unable to use the exercise equipment correctly. For example, the user's hand may not be able to grip the handlebar at all, or their hand may slide down the handlebar, or they may not be able to hold their hand and/or wrist in proper alignment due to disability. The latter condition may be referred to as wrist flexion, which causes the user's hands to curl in at the wrist toward the body center line and placing the hands in an improper position to use the machine. If the wrists are in this position on the machine for extended periods of time, the user may develop discomfort or possible injuries.

Currently, hand harnesses, sometimes referred to as "gloves" are used to aid in the operation of exercise equipment. The hand harness attaches to the handlebar and prevents the user from inadvertently relinquishing contact with the handlebar but does not prevent the users hand from improperly gripping the handlebar.

Therefore, there exists a need for a solution that not only prevents the user from inadvertently relinquishing contact with the handlebar but also properly positions the user's hands to the handlebar of the exercise equipment.

BRIEF SUMMARY OF THE INVENTION

In overcoming the drawbacks and limitations of the known technology a hand harness for a handlebar is disclosed. The hand harness of this invention includes an adjustable mount for handlebars of varying size. A channel is defined within the mount and is configured to receive the handlebar. By adjusting the diameter of the channel, handlebars of varying size can be accommodated. The mount of the harness may further include a mounting strap having a buckle. The mounting strap and buckle are used to increase and decrease the diameter of the channel of the mount.

Located at one end of the channel is a base. Attached to the base is a glove having a first portion and a second portion. The first and second portions of the glove are configured to wrap around the user's hand and lock the user's hand to the hand harness in a fixed position. The first and second portions of the glove may further include a first portion strap and a second portion strap, respectively. The first portion strap is connectable to the surface while the second portion strap is connectable to the first portion strap. When the straps are connected, a cavity and a channel are formed wherein the user's hand and wrist will be located, respectively.

These and other aspects and advantages of the present invention will become apparent upon reading the following detailed description of the invention in combination with the accompanying drawings.

DETAILED DESCRIPTION OF THE INVENTION

Figure 1:
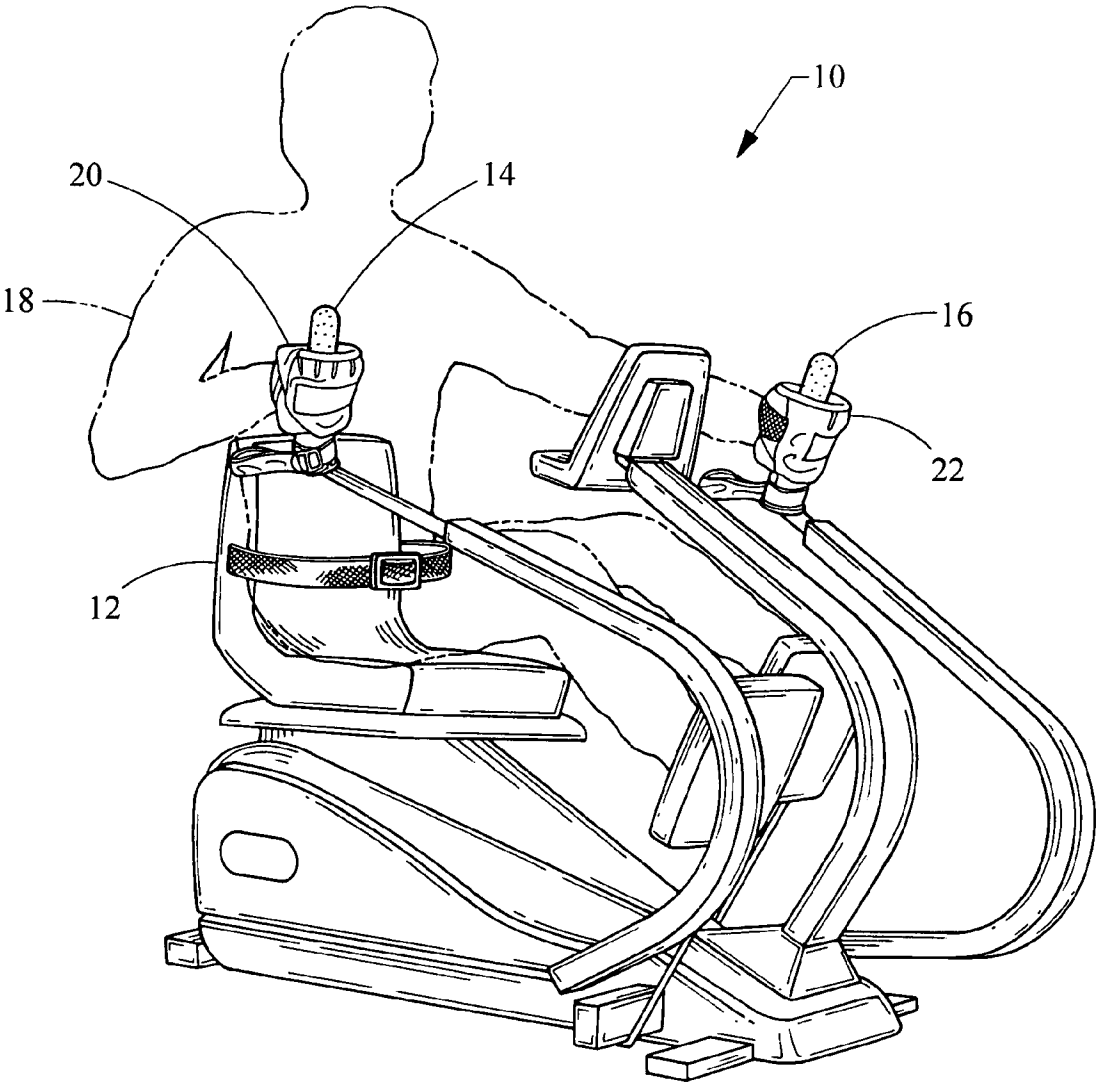
FIG. 1 is a perspective view of a recumbent cross trainer having a hand harness in accordance with one embodiment of the present invention.

Referring to FIG. 1, a recumbent cross trainer 10 is shown. The recumbent cross trainer 10 includes a seat 12 and handlebars 14 and 16. Sitting on the seat 12 is a user 18. The user 18 operates the recumbent cross trainer 10 by gripping the handlebars 14 and 16 with the occupant's hands and moving the handlebars 14 and 16 and footpedals (not numbered) in a repetitive back-and-forth motion.

Aiding the user 18 in gripping the handlebars 14 and 16 are hand harnesses 20 and 22. The hand harnesses 20 and 22 are substantially identical with the exception that each hand harness 20 and 22 are modified to conform with the right hand and left hand of the user 18, respectively. Although this embodiment shows the hand harnesses 20 and 22 being used with a recumbent cross trainer 10, the hand harnesses 20 and 22 may be used with other pieces of cardiovascular exercise equipment which requires the user to interact with handlebars.

Figure 2:
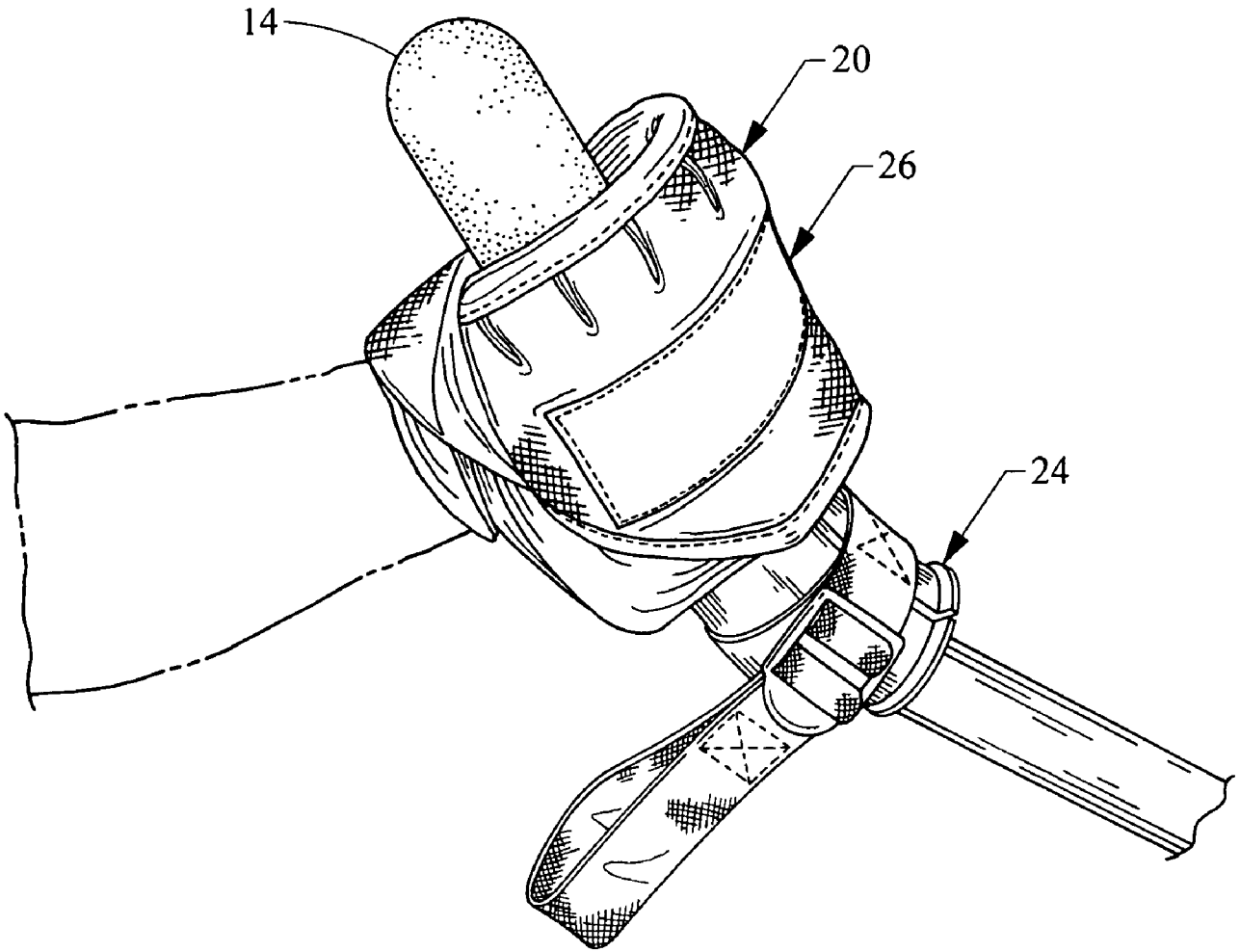
FIG. 2 is a perspective view of the hand harness shown in FIG. 1.

Referring to FIG. 2, a more detailed view of the hand harness 20 is shown. As stated previously, the hand harness 20 and the hand harness 22 are substantially identical with the exception that each hand harness 20 and 22 has been modified to better interact with the right hand and left hand of the occupant, respectively. The hand harness 20 includes a mount 24 and a glove 26. The mount 24 functions to secure the hand harness 20 to the handlebar 14 and prevent rotation or axial movement of the handlebar. The glove 26 in conjunction with the mount 24, serves to properly position the hand of the user around the handlebar 14.

Figure 3:
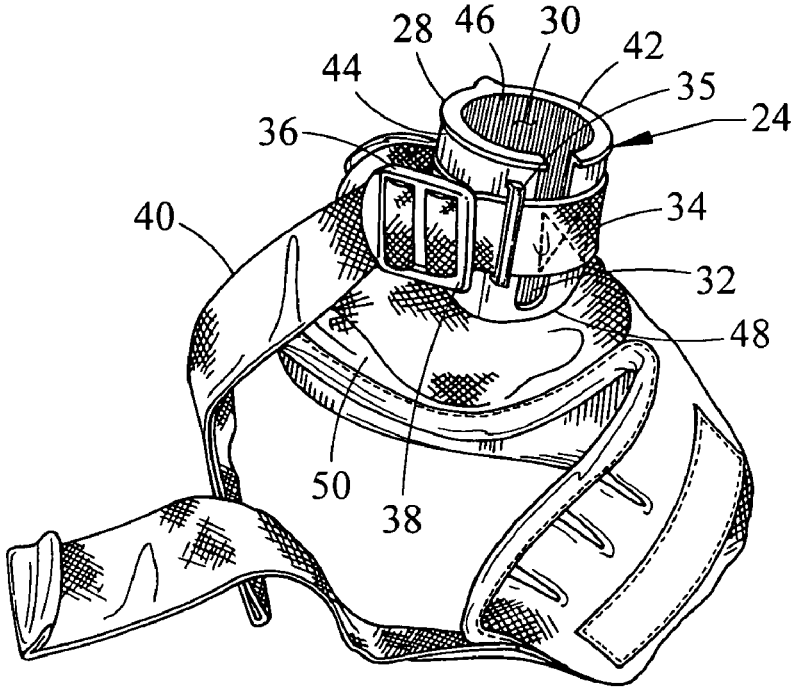
FIG. 3 is the bottom view of the hand harness shown in FIG. 2.

Referring to FIG. 3 a bottom view of the hand harness 20 is shown. The mount 24 includes wall portions 28 defining a channel 30 therein. Defined within the wall portions 28 is a gap region 32. Preferably, the wall portions 28 of the mount 24 are made of a flexible material such that the circumference of the channel 30 may be adjusted in order to accommodate handlebars of varying size.

Surrounding the exterior of the wall portion 28 is a mounting strap 34 having a free end 40 and a buckle end 38. The mounting strap has a buckle 36 attached to the buckle end 38. The buckle 36 is configured to receive the free end 40 and lock the mounting strap 34 in a fixed position around the wall portions 28. As the mounting strap 34 is tightened or loosened, the circumference of the channel 30 defined by the wall portions 28 is either decreased or increased, respectively.

A strap loop 35 is attached to the mount 24 across a first end 44 and a second end 48 of the wall portions 28. A lip 42 is located at the first end 44 of the wall portions 28. The strap loop 35 and the lip 42 function to retain the mounting strap 34 in an appropriate position. Within the inside of the wall portions 28 are a plurality of ribs 46. The ribs 46 function to increase the friction between the handlebar 14 and the mount 24 in order to prevent movement of the hand harness 20 when in operation. Alternatively, the mounting strap may be a metal band with a clamping device.

The second end 48 of the wall portions 28 is attached to a base 50. The base 50 surrounds the second end 48 of the wall portions 28, thereby allowing the channel 30 to pass through the depth of the base 50.

Figure 4:
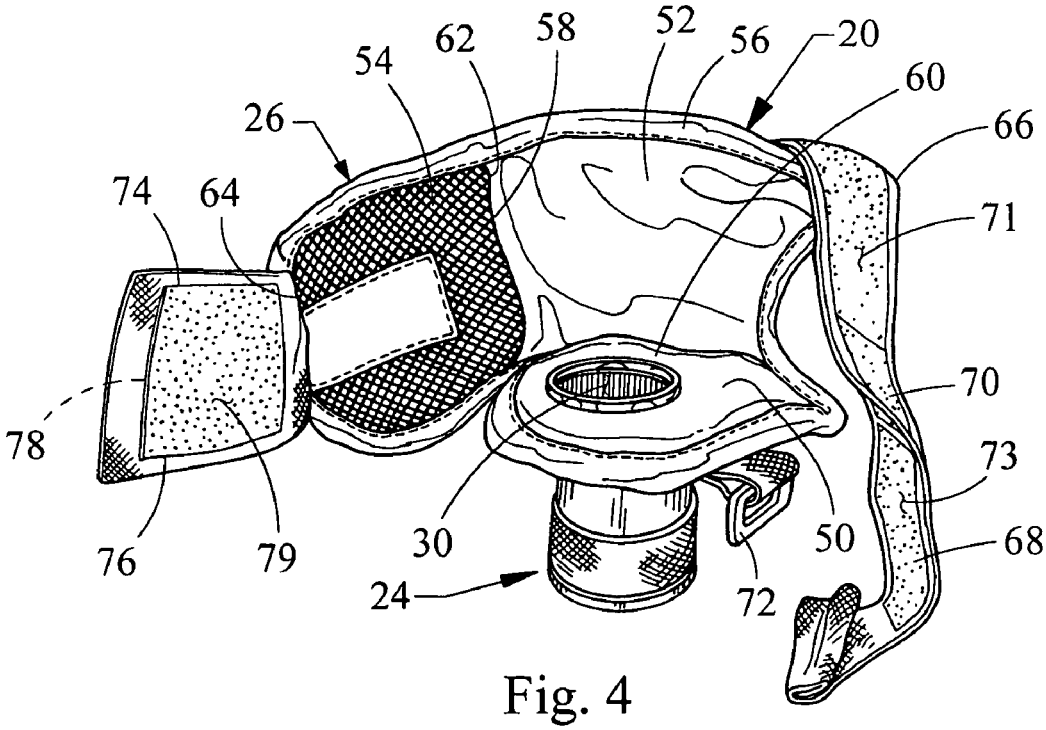
FIG. 4 is a top view of the hand harness shown in FIG. 2.
Figure 5:
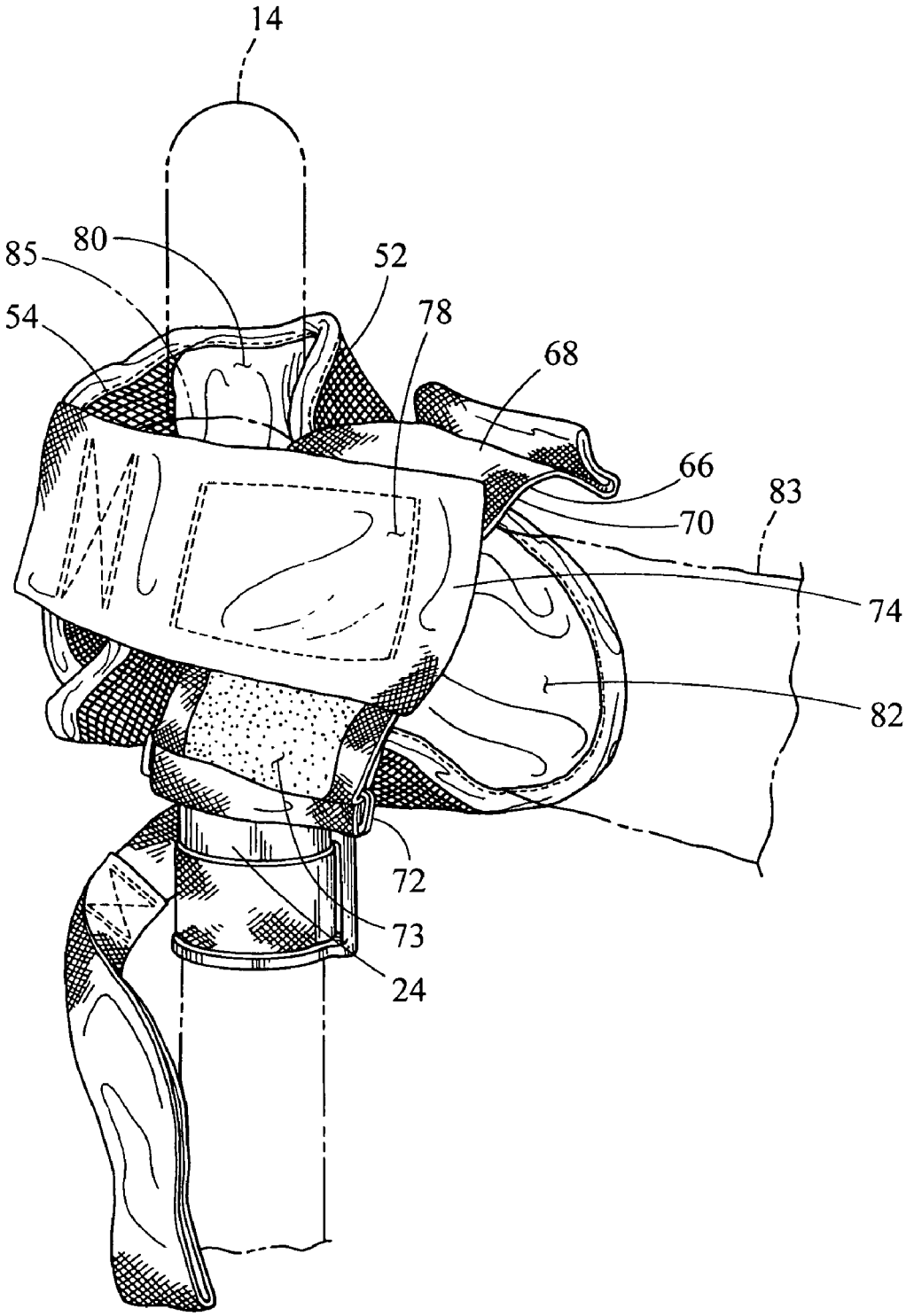
FIG. 5 is a side view of the hand harness as shown in FIG. 2 with the first and second portion straps engaged.

Referring to FIGS. 4 and 5 additional views of the hand harness 20 are shown. As stated previously, the channel 30 runs through the depth of the base 50. The shape of the base 50 is such as to provide maximum comfort to the occupant. Because the base 50 of the hand harness 20 will be in direct contact with the bottom of the user's fist, the base 50 is ergonomically contoured and tear drop shaped in order to receive and support the bottom of the user's first and wrist.

The glove portion 26 of the hand harness 20 includes a first portion 52 and a second portion 54. The first portion includes a top edge 56, a side edge 58 and a bottom edge 60. The bottom edge 60 is connected to the base 50. The second portion 54 includes a first side edge 62 and a second side edge 64. The first side edge 62 of the second portion 54 is connected to the side edge 58 of the first portion 52. Preferably, both the first and second portions 52 and 54 are constructed of a three dimensional spacer fabric. Generally, the thickness of the three-dimensional spacer fabric used in the first portion 52 is thicker than the three-dimensional spaced fabric used in the second portion 54.

Connected to the top edge of the first portion 52 is a first portion strap 66 having an inside surface 68 and an outside surface 70. Both the inside surface 68 and the outside surface 70 of the first portion strap 66 have VELCRO layers 71 and 73 connected to it. Connected to the base 50 is a buckle 72. The buckle 72 is configured to receive and lock the first portion strap 66. Once the buckle 72 receives the first portion strap 66, the first portion strap 66 is folded over onto itself. As best shown in FIG. 5, the VELCRO on the outside surface 70 attaches where the folder over outside surface 70 touches, thus, securing the first portion strap 66 around the buckle 72.

Extending from the second side edge 64 is a second portion strap 74 having an inside 76 and an outside 78. The inside 76 of the second portion strap 74 has a layer of VELCRO 79. When the first portion strap 66 is received and locked by the buckle 72, the VELCRO located on the inside 76 of the second portion strap 74 is configured to connect with the VELCRO located on the outside 68 of the first portion strap 66. As best shown in FIG. 5, when connected, a funnel shaped cavity 80 is formed within the glove portion with an opening 82 leading to the cavity 80. The cavity 80 will house the user's first 85 while the cavity 82 will surround the user's wrist 83.

Additionally, the hand harness 20 may have one or more indicators (not shown) to illustrate the correct sequence of attachment and orientation. For example, this may be a patch having "1", "2" and a "3" to indicate which straps and the correct sequence of straps to first tighten in order to properly attach the hand harness 20 to the handlebar.

In as much as the foregoing disclosure is intended to enable one skilled in the pertinent art to practice the instant invention, it should not be construed to be limited thereby but should be construed to include such aforementioned obvious variations and be limited only by the spirit and scope of the following claims.

The invention claimed is:

1. A harness for a handlebar, wherein the harness comprises:

an adjustable cylindrical mount having wall portions defining a channel with a first opening and a second opening;

a base surrounding the first opening, a surface of the base being substantially perpendicular to the length of the channel;

a glove having a first portion and a second portion, the first portion having a top edge, bottom edge, and side edge, the second portion having a first side edge and a second side edge;

the bottom edge of the first portion being connected to the surface, and the top edge of the first portion capable of being connected to the surface, thereby forming a wrist opening; and the side edge of the first portion being connected to the first side edge of the second portion, the second side edge of the second portion capable of being connected to the top edge of the first portion, thereby defining a cavity in communication with the wrist opening and allowing natural movement during operation.

2. The harness of claim 1, wherein the base is tear drop shaped and ergonomically contoured for receiving and supporting the bottom of a human first and wrist.

3. The harness of claim 1, wherein the top edge of the first portion further comprises a first portion strap connectible to the surface.

4. The harness of claim 3, further comprising a buckle connected to the surface and configured to receive and lock the first portion strap.

5. The harness of claim 3, further comprising a second portion strap connected to the second edge of the second portion and configured to be connectible to the first portion strap.

6. The harness of claim 5, further comprising an adhesive for connecting the first portion strap to the second portion strap.

7. The harness of claim 1, further comprising a mounting strap having a buckle capable of receiving the mounting strap wrapped around the mount, whereby tightening the mounting strap around the mount adjusts the diameter of the channel defined within the wall portions of the mount.

8. The harness of claim 7, further comprising a lip surrounding the second opening of the mount for retaining the mounting strap in an appropriate position around the mount.

9. The harness of claim 7, further comprising a strap loop coupled to the mount for retaining the mounting strap in an appropriate position around the mount.

10. The harness of claim 1, further comprising a metal strap having a clamp capable of receiving the mounting metal strap wrapped around the mount, whereby tightening the clamp around the mount adjusts the diameter of the channel defined within the wall portions of the mount.

11. The harness of claim 1, wherein the wall portions further comprise a plurality of ribs for enhancing the frictional engagement of the mount to the handlebar, thereby preventing radial and/or axial movement of the mount when attached to the handlebar.

12. The harness of claim 1, wherein the first and second portions of the glove are constructed of a three dimensional spacer fabric.

13. The harness of claim 12, wherein the thickness of the three-dimensional spacer fabric used in the first portion of the glove has a thickness greater than the three-dimensional spacer fabric used in the second portion of the glove.

14. The harness of claim 1, wherein the cavity is a funnel shaped cavity for cradling and securing a human hand and minimizing pressure points.

* * * * *

UNITED STATES PATENT AND TRADEMARK OFFICE

CERTIFICATE OF CORRECTION

PATENT NO. : 7,490,363 B2
APPLICATION NO. : 11/299492
DATED : February 17, 2009
INVENTOR(S) : Mark Hildebrandt et al.

It is certified that error appears in the above-identified patent and that said Letters Patent is hereby corrected as shown below:

On the Title Page

Item (73), delete "Nustep" and substitute --NuStep-- in its place.

In the Claims

In column 4, claim 2, line 30, after "bottom of a human" delete "first" and substitute --fist-- in its place.

Signed and Sealed this

Second Day of June, 2009

JOHN DOLL
*Acting Director of the United States Patent and Trademark Office*